United States Patent [19]

Murphy

[11] 4,096,071

[45] Jun. 20, 1978

[54] FABRIC TREATING COMPOSITIONS WITH MODIFIED PHASE PROPERTIES

[75] Inventor: Alan P. Murphy, Cincinnati, Ohio

[73] Assignee: The Procter & Gamble Company, Cincinnati, Ohio

[21] Appl. No.: 814,962

[22] Filed: Jul. 12, 1977

Related U.S. Application Data

[62] Division of Ser. No. 532,276, Dec. 12, 1974, Pat. No. 4,049,858.

[51] Int. Cl.[2] ..... D06M 13/20

[52] U.S. Cl. ..... 252/8.6; 252/8.7; 427/242

[58] Field of Search ..... 252/8.6, 8.8, 8.7, 8.9; 427/242

[56] References Cited

U.S. PATENT DOCUMENTS

| | | | |
|---|---|---|---|
| 2,461,043 | 2/1949 | Eisen | 252/8.6 R |
| 2,978,408 | 4/1961 | Lanner et al. | 252/8.6 |
| 3,666,661 | 5/1972 | Arai et al. | 252/8.9 |
| 3,686,025 | 8/1972 | Morton | 252/8.6 |
| 3,793,196 | 2/1974 | Orazaki et al. | 252/8.8 |

*Primary Examiner*—William E. Schulz
*Attorney, Agent, or Firm*—Rose Ann Dabek; Jerry J. Yetter; Richard C. Witte

[57] ABSTRACT

A non-staining fabric softening composition comprising sorbitan esters in combination with soaps or tallowalkyl sulfates is used to soften fabrics in an automatic dryer.

9 Claims, No Drawings

FABRIC TREATING COMPOSITIONS WITH MODIFIED PHASE PROPERTIES

This is a division, of application Ser. No. 532,276, filed Dec. 12, 1974, for FABRIC TREATING COMPOSITIONS WITH MODIFIED PHASE PROPERTIES, by Alan P. Murphy, and now U.S. Pat. 4,049,858.

BACKGROUND OF THE INVENTION

The present invention encompasses a means for softening fabrics in an automatic dryer. More specifically, certain sorbitan esters, used in combination with certain surfactants, have now been found to be non-staining and useful as dryer-added fabric softeners. The ester-surfactant mixtures herein are conveniently employed in combination with a dispensing means adapted for use in an automatic clothes dryer.

Treatment in an automatic clothes dryer has been shown to be an effective means for imparting desirable tactile properties to fabrics. For example, it is becoming common to soften fabrics in clothes dryers rather than during the rinse cycle of a laundering operation.

Fabric "softness" is an expression well-defined in the art and is usually understood to be that quality of the treated fabric whereby its handle or texture is smooth, pliable and fluffy to the touch. Various chemical compounds have long been known to possess the ability to soften fabrics during a laundering or rinsing operation.

The use of fabric softening compounds and compositions designed for application in an automatic dryer has been the subject of recent innovations. Various materials have been suggested for use as dryer-added fabric softeners. In particular, the copending application of Murphy, Diehl, McCarty and Seiden, Ser. Number 461,311, filed Apr. 16, 1974, P&G Attorney's Docket No. 2072, discloses certain sorbitan esters which are especially suited as dryer-added fabric softeners.

As pointed out in the prior art, many softening agents stain or discolor conditioned fabrics, especially those made with synthetic fibers. This unfortunate staining tendency is apparently caused by the presence of the fatty alkyl groups in the active softening compounds. Thus, the chemical structure which gives rise to the soft, lubricious feel associated with these materials also causes them to be potential fabric stainers.

Heretofore, a variety of mechanical methods have been employed in an attempt to reduce the tendency of dryer-added softeners to stain fabrics. Prior art fabric softening agents have been sorbed into flexible articles which provide controlled release at dryer operating temperatures. Various rigid dispensers and appliances have been designed which assertedly avoid any exceptionally high concentrations of softening agent being undesirably deposited on the fabrics in the form of greasy stains. However, such dispensers are costly and have not come into general use.

The sorbitan ester softeners referred to hereinabove have less of a tendency to stain fabrics than do many of the prior art materials. However, even the sorbitan esters can stain fabrics under certain conditions, e.g., when softening all-polyester fabrics, especially under situations wherein the sorbitan ester is undesirably deposited in gross amounts over a small surface area of the fabric being softened.

It has now been found that, by combining the sorbitan esters with certain phase-modifying agents as hereinafter disclosed, their residual tendency toward staining is suppressed.

The copending application of Murphy and Habermehl, entitled FABRIC TREATMENT COMPOSITIONS, Ser. No. 440,932, filed Feb. 8, 1974, discloses the use of tallowalkyl sulfates to provide controlled, non-staining release of triglyceride fabric softeners from various dispensing means adapted for use in an automatic clothes dryer. In contrast with the triglyceride compositions disclosed in that application which are preferably substantially free from fatty acid soaps, it has now been discovered that soaps are one type of material which are particularly useful in still further reducing the inherently low tendency of the sorbitan esters to stain.

It is an object of the present invention to provide a non-staining means for softening fabrics, especially in an automatic clothes dryer.

Another object herein is to provide articles of manufacture especially adapted for use in an automatic dryer to provide a softness aspect to fabrics without staining.

These and other objects are obtained herein as will be seen from the following disclosure.

SUMMARY OF THE INVENTION

This invention is bottomed on the discovery that commercial mixtures of sorbitan esters, as hereinafter described, are melted to a fluid oil by the heat of an automatic clothes dryer. The fluid oil can then wick onto fabrics to form stains. It has now been discovered that this wicking/staining effect can be corrected by modifying the hydration behavior of the sorbitan ester mixture so that a viscous, apparently "neat" mesomorphic phase is formed as the ester is exposed to the hot humid conditions of the dryer. (The term "neat" phase as employed herein is the same as that used in the detergent arts to describe the mesomorphic phase formed when many long-chain surfactants are combined with the proper amount of water.) The viscous, mesomorphic phase can then "crayon" onto the fabrics as the clothes tumble, but will not wick into the fabrics. Thus, even though the mesomorphic phase/oil phase transition point will be reached in the dryer as water is driven off and the temperature increases, by this time the softener active is well dispersed over all fabric surfaces by the tumbling action of the dryer, with the net result that no visual staining occurs.

The foregoing benefits are secured by means of a fabric softener mixture comprising a fabric softener component which is a sorbitan ester and a phase-modifying component which can be a fatty acid soap or a neutralized alkyl sulfate, all as more fully described hereinafter.

DETAILED DESCRIPTION OF THE INVENTION

The present invention encompasses a non-staining fabric softener mixture especially adapted for use in an automatic clothes dryer, comprising:

(a) a fabric softener component comprising a member selected from the group consisting of sorbitan esters characterized by at least one free hydroxyl group and a melting point of at least about 38° C, and mixtures thereof, said softener component being substantially free of un-neutralized fatty acids; and (b) a phase-modifying component selected from the group consisting of water-soluble fatty acid soaps, and mixtures thereof, and water-soluble $C_{10}$–$C_{20}$ neutralized alkyl sulfates, and mixtures thereof, the weight ratio of said softener component to said phase-modifying component being in the range of from about 100:1 to about 1:1;

said softener mixture being characterized by a melting point in the range of from about 38° C to about 100° C.

The non-staining fabric softener mixtures are conveniently used in the form of an article especially adapted for use in an automatic clothes dryer, said article comprising a fabric softener mixture as hereinabove described in releasable combination with a dispensing means. The article is tumbled with damp fabrics, under heat sufficient to melt the softener mixture and to dry the fabrics.

The fabric softener component and the phase-modifying component of the softener mixture herein, the dispensing means, and the preparation and use thereof, are described hereinafter.

FABRIC SOFTENER COMPONENT

The fabric softener employed in the present invention comprises the esterified cyclic dehydration products of sorbitol. Sorbitol, itself prepared by the catalytic hydrogenation of glucose, can be dehydrated in well-known fashion to form mixtures of cyclic 1,4- and 1,5-sorbitol anhydrides according to the following reaction (see U.S. Pat. No. 2,322,821):

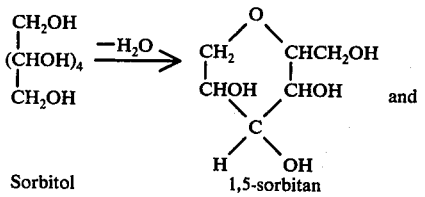

Sorbitol 1,5-sorbitan

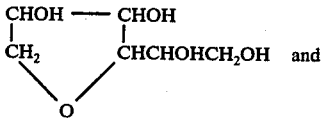

1,4-Sorbitan

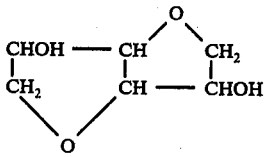

Isosorbide

The foregoing complex mixtures of cyclic anhydrides of sorbitol are collectively referred to herein as "sorbitan".

Fabric softeners of the type employed herein are prepared by esterifying the "sorbitan" mixture with a fatty acyl group in standard fashion, e.g., by reaction with a fatty acid halide or fatty acid. The esterification reaction can occur at any of the available hydroxyl groups, and various mono-, di-, etc., esters can be prepared. In fact, mixtures of mono-, di-, tri-, etc., esters almost always result from such reactions, and the stoichiometric ratios of the reactants can simply be adjusted to favor the desired reaction product. The sorbitan mono-esters, di-esters, and tri-esters are preferred for use in the present invention. While not intending to be limited by theory, it appears that to be optimally useful as a softener, the sorbitan esters should contain unesterified hydroxyl groups to provide hydrogen bonding with, and attachment to, fabric surfaces. The mono-, di- and tri-esters of sorbitan fulfill this requirement.

The mixtures of hydroxy-substituted sorbitan esters useful herein contain, inter alia, compounds of the following formulae, as well as the corresponding hydroxy-substituted di-esters:

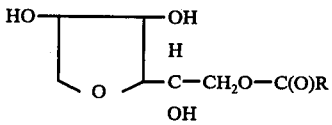

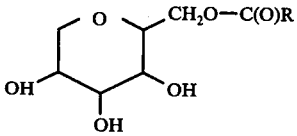

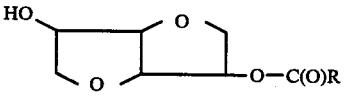

wherein group RC(O) - is a ca. $C_{10}$–$C_{24}$ fatty alkyl residue. The foregoing complex mixtures of esterified cyclic dehydration products of sorbitol are collectively referred to herein as "sorbitan esters".

In this manner there can be prepared, for example, the sorbitan mono-, di-, and tri-esters of lauric, myristic, palmitic, stearic and behenic acids, all of which are particularly useful herein for imparting a soft, lubricious feel and anti-static benefits to fabrics. Mixed sorbitan esters, e.g., mixture of the foregoing esters, and mixtures prepared by esterifying sorbitan with fatty acid mixtures such as the mixed tallow and hydrogenated palm oil fatty acids, are useful herein and are economically attractive. Unsaturated $C_{10}$–$C_{18}$ sorbitan esters, e.g., sorbitan mono-oleate, usually are present in such mixtures. The term "alkyl" as employed herein to describe the sorbitan esters encompasses both the saturated and unsaturated hydrocarbyl ester side-chain groups. Moreover, it is to be recognized that all sorbitan esters containing free -OH groups which soften and flow at dryer operating temperatures, i.e., above about 38° C, but which are solid below about 38° C, and which have a fatty hydrocarbyl "tail", are useful softeners in the context of the present invention; the $C_{10}$–$C_{22}$ alkyl mono- and di-esters are most highly preferred.

While the sorbitan esters herein can be secured by cyclizing sorbitol to form a mixture of cyclic anhydrides of the type set forth above and separating and esterifying the various cyclic anhydrides using the appropriate reaction stoichiometry, separation of the cyclization products is difficult and expensive. On a commercial scale, it is easier and more economical not to separate the various cyclic anhydrides, but simply to esterify the total mixture using an excess of the esterifying agent. Of course, this results in esterified mixtures of the type disclosed above. Such complex mixtures of esterified reaction products are commercially available under various tradenames, e.g., Span ®.

It has now been found that the free (un-neutralized) fatty acids present in these complex sorbitan ester mixtures can cause the esters to melt prematurely to an oily phase which stains fabrics. It has further been discovered that by neutralizing the sorbitan ester mixtures with base, thereby converting substantially all free fatty acids to their salt form, i.e., soaps, this staining tendency is substantially reduced.

Moreover, it has been discovered that neutralizing substantially all free fatty acids present in the complex sorbitan ester mixtures to their water-soluble soap form not only rids the mixture of the deleterious fatty acids, but also desirably modifies the phase behavior of the ester mixture by virtue of the presence of the resulting soaps. Accordingly, neutralization of the mixed sorbitan esters unexpectedly provides a net benefit to the softener component.

In light of the foregoing, it is now possible to characterize preferred, non-staining sorbitan ester fabric softeners as those which are substantially free of un-neutralized fatty acids, and which have the melting points, free -OH groups, etc., as defined above. Such highly preferred alkyl sorbitan esters include the $C_{10}$–$C_{22}$ alkyl mono- and di-sorbitan esters, e.g., sorbitan monolaurate, sorbitan monomyristate, sorbitan monopalmitate, sorbitan monostearate, sorbitan dilaurate, sorbitan dimyristate, sorbitan dipalmitate, sorbitan distearate, and mixtures thereof, and mixed coconutalkyl sorbitan mono- and di-esters and mixed tallowalkyl sorbitan mono- and di-esters, said esters and mixtures being substantially free of un-neutralized fatty acids. Such mixtures are readily prepared by reacting the foregoing cyclic, hydroxy-substituted sorbitans, particularly the 1,4- and 1,5-sorbitans, with the corresponding acid or acid chloride in a simple esterification reaction.

It is to be recognized further that commercial sorbitan esters will contain minor proportions of uncyclized sorbitol, and esters thereof, polymers, isosorbide structures, and the like. The presence or absence of such materials as minor components of the sorbitan esters is of no consequence to their use as softeners, once the free fatty acids are neutralized.

For most purposes, the commercially available sorbitan esters which comprise at least about 40% by weight, preferably at least about 60% by weight, of mono- and di-esters and which have melting points of at least about 38° C can be neutralized to convert any free fatty acids to soaps and advantageously employed to soften clothes in the manner of this invention. Highly preferred softener components used herein include sorbitan monostearate, sorbitan monopalmitate, and 1:10 to 10:1 (wt.) mixtures thereof, said mixtures being substantially free of un-neutralized fatty acids. Both the 1,4- and 1,5-cyclic sorbitan stearates and palmitates are useful herein, inasmuch as their melting points are above 38° C and they contain at least one hydroxyl group which provides a mode of attachment to fabric surfaces.

PHASE-MODIFYING COMPONENT

The neutralization of the sorbitan ester mixtures in the foregoing manner results in a fabric softener mixture comprising both the sorbitan esters and a water-soluble fatty acid soap which is a desirable phase-modifying component of the mixture. In order to provide fabric softener mixtures which are non-staining, it is a critical aspect of the present invention that the weight ratio of the sorbitan ester softener component to the phase-modifying component be in the range of from about 100:1 to about 1:1, more preferably from about 20:1 to about 5:1.

Of course, the amount of soap which will be present in the overall softener mixture herein by virtue of the neutralization of the sorbitan ester mixture will depend on the amount of free fatty acid present in said mixture, which will depend, in turn, on the details of the manufacturing process used to prepare said esters. In some instances wherein a large excess of fatty acid or acid halide has been used to esterify the sorbitan mixture, sufficient free fatty acid will be present to form the desired amount of soap after simple neutralization. For the most part, however, the sorbitan esters will not contain enough free fatty acid to form the desired amount of soap; in such instances, additional soap is added to the fabric softener component to provide a softener mixture of the non-staining type of the present invention.

The soaps used as a phase-modifying component are the water-soluble fatty acid soaps, especially those having a fatty acid group of from $C_{10}$–$C_{20}$, preferably $C_{12}$–$C_{18}$. The soaps herein are, of course, neutralized fatty acids containing various cations as counterions for the acyl group. The counterion should be one which causes the soap to be water-soluble, i.e., alkali metal, ammonium, alkanolammonium, and the like. The heavy metal ion soaps, e.g., calcium and magnesium soaps, are not useful herein, inasmuch as they are not substantially water-soluble. Conveniently, the soap used as a phase-modifying component herein is in the sodium salt form. Moreover, it is convenient and economical to use sodium hydroxide as the base for neutralizing the free fatty acids in the sorbitan esters. However, other alkali metal bases and ammonio bases can be used for this purpose and water-soluble soaps are formed from the residual fatty acid in the sorbitan ester mixture.

Pure soaps having well-defined chain lengths in the range of $C_{10}$–$C_{20}$ can be employed herein. However, it is not necessary to incur the expense of using pure soaps, since soap mixtures are quite suitable. Sodium tallowalkyl soap, sodium coconutalkyl soap, or mixtures thereof, especially mixtures comprising sodium tallowalkyl soap and sodium coconutalkyl soap at a weight ratio of tallowalkyl soap: coconutalkyl soap of from about 5:1 to about 1:1 are especially preferred as the phase-modifying component of the present compositions.

In addition to the above-described soap phase-modifying components herein, it has also been found that neutralized, water-soluble $C_{10}$–$C_{20}$ alkyl sulfates, and mixtures thereof, are suitable for use as the phase-modifying component in the present softener mixtures. The alkyl sulfates employed herein are those well known in the detergency arts, and can be either the individual pure chain length materials, or preferably, mixtures of such materials. The alkyl sulfates employed herein are prepared from the acid form of the alkyl sulfate by neutralizing with any base which will provide a water-soluble material, in the manner described hereinabove for the soaps. As with the soaps, useful alkyl sulfates herein include the alkali metal, ammonium and alkanolammonium neutralized materials; alkyl sulfates in the sodium salt form are highly preferred. The most preferred alkyl sulfate mixture herein, for reasons of economy and its inherent phase-modifying behavior, is sodium tallowalkyl sulfate.

It is to be recognized that due to the neutralization step usually employed with commercial sorbitan esters to render them substantially free of un-neutralized fatty acids, the alkyl sulfate phase-modifying materials will commonly be present in the softener mixture with a soap. This is of no import to the present invention except that proportionately less of the tallowalkyl sulfate will have to be added to the mixture to bring the weight ratio of the softener component:phase-modifying component within the range recited hereinabove.

The alkyl sulfate materials are employed in the present softener mixtures at a weight ratio of softener component to alkyl sulfate in the range of from about 100:1 to about 1:1, preferably 5:1 to 20:1.

SOFTENER MIXTURE PREPARATION

In general, the softener mixtures herein are prepared by neutralizing the commercial sorbitan ester containing the free fatty acids. The neutralization is carried out in standard fashion using an aqueous solution of any desired base. The ester is simply titrated with base until neutral, or nearly neutral, thereby insuring conversion of all un-neutralized free fatty acids to the soap form.

The neutralization reaction can be carried out using any base. However, inasmuch as the phase-modifying component of the present invention must be a water-soluble material, it is preferred to use a base which will result in the formation of a water-soluble soap after neutralization of the fatty acids. Representative bases which result in the formation of water-soluble soaps include the alkali metal hydroxides, e.g., sodium hydroxide, potassium hydroxide, and the like, as well as ammonium hydroxide, and the various alkanol amines. Sodium hydroxide is preferred herein by virtue of its low cost and high reactivity.

As noted hereinabove, simply neutralizing the free acids in most commercial sorbitan ester mixtures will not provide sufficient soap to substantially alter the phase properties of the esters in the manner of this invention. Moreover, if it is desired to use the alkyl sulfates as the phase-modifying material, these must be added separately, and this addition can be done in a simple blending operation.

The softener mixtures prepared in the foregoing manner have a melting point in the range of from about 38° to about 100° C, i.e., the broad temperature ranges encountered in both home and commercial dryers. Most home dryers operate in a range of from about 57° to about 75° C, and it is most preferred herein to provide softener mixtures which melt and flow within this range, but which are substantially solid below about 38° C.

DISPENSING MEANS

The non-staining fabric softener mixture of the foregoing type can be employed by simply placing a measured amount in the dryer, e.g., as a foam, dispersion, or by simply sprinkling over the fabrics. However, in a preferred embodiment the mixture is provided as an article of manufacture in combination with a dispensing means which effectively releases a pre-selected amount of the mixture in an automatic clothes dryer. Such dispensing means can be designed for single usage or for multiple uses.

One such article comprises a pouch releasably enclosing enough of the softener mixture to treat fabrics during several cycles of clothes. This multi-use article can be made by filling a hollow, open pore polyurethane sponge pouch with about 10 grams of the mixture. In use, the tumbling action of the dryer causes the mixture to pass through the pores of the sponge and onto the fabrics. Such a filled sponge can be used to treat several loads of fabrics in conventional dryers, and has the advantage that it can remain in the dryer after use and is not likely to be misplaced or lost.

Another article comprises a cloth or paper bag releasably enclosing the softener mixture and sealed with a wax which softens at dryer operating temperatures. The action of the dryer opens the bag and releases the mixture to perform its softening function.

A highly preferred article herein comprises the softener mixture releasably affixed to a sheet of paper or woven or non-woven cloth substrate such that the action of the automatic dryer removes the mixture and deposits it on the fabrics.

The sheet conformation has several advantages. For example, effective amounts of the softener mixture for use in conventional dryers can be easily sorbed onto and into the sheet substrate by simple dipping or padding processes. Thus, the user need not measure the amount of the mixture necessary to soften fabrics. Additionally, the flat configuration of the sheet provides a large surface area which results in efficient release of the mixture onto fabrics by the tumbling action of the dryer.

The water-insoluble paper, or woven or non-woven substrates used in the sheet articles herein can have a dense, or more preferably, open or porous structure. Examples of suitable materials which can be used as substrates herein include paper, woven cloth, and non-woven cloth. The term "cloth" herein means a woven or non-woven substrate for the articles of manufacture, as distinguished from the term "fabric" which encompasses the clothing fabrics being dried in an automatic dryer.

Highly preferred paper, woven or non-woven "absorbent" substrates useful herein are fully disclosed in U.S. Pat. No. 3,686,025, Morton, TEXTILE SOFTENING AGENTS IMPREGNATED INTO ABSORBENT MATERIALS, issued Aug. 22, 1972, incorporated herein by reference. It is known that most substances are able to absorb a liquid substance to some degree; however, the term "absorbent", as used herein, is intended to mean a substance with an absorbent capacity (i.e., a parameter representing a substrate's ability to take up and retain a liquid) from 5.5 to 12, preferably 7 to 10, times its weight of water.

Determination of absorbent capacity values of the preferred substrates herein is made by using the capacity testing procedures described in U.S. Federal Specifications UU-T-595b, modified as follows:

(1) tap water is used instead of distilled water;
(2) the specimen is immersed for 30 seconds instead of 3 minutes;
(3) the draining time is 15 seconds instead of 1 minute; and
(4) the specimen is immediately weighed on a torsion balance having a pan with turned-up edges.

Absorbent capacity values are then calculated in accordance with the formula given in said Specification.

Using a substrate with an absorbent capacity of less than 5.5 tends to cause too rapid release of the softener mixture from the substrate in the preferred articles herein resulting in several disadvantages, one of which is uneven softening of the fabrics. Using a substrate with an absorbent capacity over 12 is undesirable, inasmuch as too little of the mixture is released to soften the fabrics in optimal fashion during a normal drying cycle.

The preferred substrates of this invention can also be defined in terms of "free space", and have from about 40% to about 90%, preferably about 55%, free space based on the overall volume of the substrate's structure. This free space is directly related to the substrate's having an absorbency value of 5.5 to 12.

The use of dense, one-ply or ordinary kraft or bond paper in articles containing the softening agent can result in increased staining of certain types of treated fabrics, and is preferably avoided herein. This staining is caused by the low absorbent capacity of the paper substrate.

As noted above, suitable materials which can be used as a substrate in the invention herein include, among others, sponges, paper, and woven and non-woven cloth, all having the absorbency parameters defined above. The preferred substrates for the articles herein are cellulosic, particularly multi-ply paper and non-woven cloth.

More specifically, a preferred paper substrate comprises a compressible, laminated, calendered, multi-ply, absorbent paper structure. Preferably, the paper structure has 2 or 3 plies and a total basis weight of from 14 to 90 pounds per 3,000 square feet and absorbent capacity values within the range of 7 to 10. Each ply of the preferred paper structure has a basis weight of about 7 to 30 pounds per 3,000 square feet, and the paper structure can consist of plies having the same or different basis weights. Each ply is preferably made from a creped, or otherwise extensible, paper with a creped percentage of about 15% to 40% and a machine direction (MD) tensile and cross-machine (CD) tensile of from about 100 to 1,500 grams per square inch of paper width. The two outer plies of a 3-ply paper structure or each ply of a 2-ply paper structure are embossed with identical repeating patterns consisting of about 16 to 200 discrete protuberances per square inch, raised to a height of from about 0.010 inch to 0.40 inch above the surface of the unembossed paper sheet. From about 10% to 60% of the paper sheet surface is raised. The distal ends (i.e., the ends away from the unembossed paper sheet surface) of the protuberances on each ply are mated and adhesively joined together, thereby providing a preferred paper structure exhibiting a compressive modulus of from about 200 to 800 inch-grams per cubic inch and Handle-O-Meter (HOM) MD and CD values of from about 10 to 130; see U.S. Pat. No. 3,414,459, Wells, COMPRESSIBLE LAMINATED PAPER STRUCTURE, issued Dec. 3, 1968, the disclosures of which are incorporated herein by reference.

Methods of making non-woven cloths are not a part of this invention and, being well known in the art, are not described in detail herein. Generally, such cloths are made by air- or water-laying processes in which the fibers or filaments are first cut to desired lengths from long strands, passed into a water or air stream, and then deposited onto a screen through which the fiber-laden air or water is passed. The deposited fibers or filaments are then adhesively bonded together, dried, cured, and otherwise treated as desired to form the non-woven cloth. Non-woven cloths made of polyesters, polyamides, vinyl resins, and other thermoplastic fibers can be span-bonded, i.e., the fibers are spun out onto a flat surface and bonded (melted) together by heat or by chemical reactions.

Preferred non-woven cloth substrates herein are water-laid or air-laid and are made from cellulosic fibers, particularly from regenerated cellulose or rayon, which are lubricated with any standard textile lubricant. Preferably, the fibers are from 3/16 inch to 2 inches in length and are from 1.5 to 5 denier. Preferably, the fibers are at least partially oriented haphazardly, particularly substantially haphazardly, and are adhesively bonded together with a hydrophobic or substantially hydrophobic binder-resin, particularly with a nonionic self-crosslinking acrylic polymer or polymers. Preferably, the cloth comprises about 70% fiber and 30% binder-resin polymer by weight and has a basis weight of from about 20 to 24 grams per square yard.

The articles of the present invention are structured to be compatible with conventional laundry dryer designs. While it is preferred to employ the articles in an automatic laundry dryer, other equivalent machines can be employed, and in some instances, heat and drying air can be omitted for part or all of the cycle. Generally, however, heated air will be employed and such air will be circulated frequently in the dryer. Normally, there are from about 5 to 50 volume changes of drying air in the dryer drum per minute and the air moves at about 125 to 175 cubic feet per minute. These changing volumes of air create a drawing or suction effect which can, especially with small fabric loads, cause an item such as a sock, handkerchief or the like, or a fabric conditioning article, to be disposed on the surface of the air outlet of the dryer. A usual load of fabrics of from about 4 to 12 pounds dry weight will fill from about 10% to 70% of the volume of most dryers and will normally pose little difficulty. A sufficient number of tumbling items will normally be present to prevent any item from being drawn to the exhaust outlet or to cause it to be removed from the outlet. In the event, however, a fabric conditioning article is caused to be disposed in relation to the air exhaust outlet in such a manner as to cause blockage of passing air, undesirable temperature increases can result. In the case of fabric conditioning articles employing the normally solid or waxy softeners (e.g., sorbitan esters) which soften or melt under conditions of heat, the article may tend to adhere to an exhaust outlet.

The problem of blockage can be solved by providing openings in the article in the manner described in the U.S. patent applications of A. R. McQueary, Ser. No. 347,605, filed Apr. 3, 1973, and Ser. No. 347,606, filed Apr. 3, 1973, both incorporated herein by reference. More specifically, slits or holes are cut through the substrate to allow free passage of air.

The slit openings are provided in the fabric conditioning articles of the invention for two principal purposes. Importantly, the slits permit passage of air in the event the article is placed in a blocking relationship to the air exhaust outlet. Moreover, the slit openings provide a degree of flexibility or resiliency which causes the article to crumple or pucker. The effect of such crumpling is that only a portion of the air exhaust outlet will be covered by the conditioning article in the event it is carried by the moving air stream to the exhaust outlet. Moreover, the crumpled article is more readily removed by tumbling fabrics than would be the case if the article were placed in a flat relationship to the exhaust outlet.

The type and number of slit openings can vary considerably and will depend upon the nature of the substrate material, its inherent flexibility or rigidity, the nature of the conditioning agent carried therein or thereon, and the extent to which increased passage of air therethrough is desired. The articles of this invention can comprise a large number of small slits of various types or configurations, or fewer larger slits. For example, a single rectilinear or wavy slit, or a plurality thereof, confined to within the area of a sheet and extending close to opposite edges of the article, can be employed. By maintaining a border around all edges of the conditioning article, a desired degree of flexibility and surface area availability to tumbling fabrics can be maintained. While, for example, rectilinear slits can be cut into a conditioning article completely to the edges of the article, confinement of the slits to within the area of the article will be preferred where the convenience of packaging the conditioning article in roll form is desired.

According to one preferred embodiment of the invention, a sheet of fabric-conditioning article is provided with a plurality of rectilinear slits extending in one direction, e.g., the machine direction of the web substrate, and in a substantially parallel relationship. The slits can be aligned or in a staggered relationship. A preferred embodiment will contain from 5 to 9 of such slits which will extend to within about 2 inches and preferably 1 inch from the edge of the web material which is, for example, a 9 inch × 11 inch sheet. In general, the greater the number and the longer the slits, the greater the effect in preventing restriction of air flow. Such an article permits the individual panel areas or sections within the rectilinear slits to flex or move in independent relationship to each other and out of the plane of the sheet. This flexing minimizes the probability that such an article will align itself in a flat and blocking relationship to an exhaust outlet. The inherent puckering or crumpling tendency of the article allows the article to contact the air outlet in such a manner as to leave at least a portion of the air exhaust outlet uncovered. In addition, the tumbling fabrics in the dryer will collide with the crumpled article causing it to be removed from the exhaust outlet. Removal is readily accomplished by reason of the protrusion of the crumpled article which makes it more available for contact with the tumbling load of fabrics in the dryer.

The slit openings in the conditioning articles of the invention can be in a variety of configurations and sizes, as can be readily appreciated. In some instances, it may be desirable to provide slit openings as C-, U-, or V-shaped slits. Such slits arranged in a continuous or regular or irregular pattern are desirable from the standpoint of permitting gate-like or flap structures which permit the passage or air therethrough.

In accordance with a preferred embodiment of the invention, a plurality of curvilinear slit openings, such as U-shaped, or C-shaped slits, are provided in a continuously patterned arrangement. These slit arrangements provide flap-like or gate-like structures which should approximate the size of the perforations normally employed in laundry dryer exhaust outlets. A width dimension of from about 0.02 to about 0.40 inch is preferred. U- or C-shaped slits, e.g., about ⅛ inch in diameter, are desirably provided in close proximity to each other, e.g., about ⅛ inch apart, as to simulate, for example, a fish-scale pattern. Such design, in addition to permitting passage of air, provides a degree of flexibility to the substrate and allows flexing or puckering of the article in use. Similarly, the slit openings can be arranged as spaced rows of slits or as a plurality of geometrical patterns. For example, a sheeted article of this invention can comprise a plurality of squares, circles, triangles or the like, each of which is comprised of a plurality of individual slits. Other embodiments including small or large S-shaped slits, X-slits or crosses, slits conforming to alphabetical or numerical patterns, logograms, marks, floral and other designs can also be employed.

As an alternative to slits, the article can be provided with one or more circular holes having a diameter of from about 0.02 inch to about 4 inches, from about 5% to about 40% of the surface area of the article comprising said holes. The holes can be disposed in any convenient relationship to one another but it is simplest, from a manufacturing standpoint, to punch the holes through the substrate in evenly spaced rows.

OPTIONAL COMPONENTS

Various additives can also be used in combination with the softener mixtures and articles herein. Although not essential to the present invention, certain fabric treating additives are particularly desirable and useful, e.g., perfumes, brightening agents, shrinkage controllers, spotting agents, and the like. Various non-interfering anti-stats can optionally be added to the softeners to provide an additional increment of static control over that inherently provided by the softener mixtures herein, but are not essential for this purpose.

While not essential, liquids which serve as a carrier for the softener mixture can be employed. When preparing an article for use in a dryer, such liquids can be used to more evenly impregnate the absorbent substrate with the softener mixture. When a liquid carrier is so used, it should preferably be inert or stable with the fabric softener mixture. Moreover, the liquid carrier should be substantially evaporated at room temperatures, and the residue (i.e., the softening agent) should then be sufficiently hardened so as not to run or drip off the substrate, or cause the substrate to stick together when folded. Isopropyl alcohol or isopropyl alcohol/water mixtures are the preferred liquid carriers for these purposes; methanol, ethanol, acetone, ethylene glycol or propylene glycol can also be used.

Other additives can include anti-creasing agents, finishing agents, fumigants, lubricants, fungicides, and sizing agents. Specific examples of useful additives disclosed herein can be found in any current Year Book of the American Association of Textile Chemists and Colorists. Any additive used should be compatible with the softener mixture.

The amounts of additives (e.g., perfume and brighteners) that are generally used in combination with a softening agent are small, being in the range of from 0.01% to 10% by weight of the softener mixture.

ARTICLE MANUFACTURE

The articles herein comprise the softener mixture in combination with a carrier substrate. Highly preferred articles herein are those wherein the mixture is impregnated into an absorbent substrate. The impregnation can be done in any convenient manner, and many methods are known in the art. For example, the softener mixture, in liquid form, can be sprayed onto a substrate or can be added to a wood-pulp slurry from which the substrate is manufactured.

Impregnating, rather than coating, the substrate with the softener mixture provides optimal softening without fabric staining. The term "coating" connotes the adjoining of one substance to the external surface of another; "impregnating" is intended to mean the permeation of the entire substrate structure, internally as well as externally. One factor affecting a given substrate's absorbent capacity is its free space. Accordingly, when a softener is applied to an absorbent substrate, it penetrates into the free space; hence, the substrate is deemed impregnated. The free space in a substrate of low absorbency, such as a one-ply kraft or bond paper, is very limited; such a substrate is, therefore, termed "dense". Thus, while a small portion of the softener mixture penetrates into the limited free space available in a dense substrate, a rather substantial balance does not penetrate and remains on the surface of the substrate so that it is deemed a coating. The difference between coating and impregnation is believed to explain why the softener-impregnated sheet substrates of the invention herein are preferred for eliminating or substantially reducing the staining of fabrics observed when a softener-coated dense substrate is utilized.

In a preferred method of making the impregnated absorbent sheet substrate, the softener mixture (alone or with the optional additives) is applied to absorbent paper or non-woven cloth by a method generally known as padding. The mixture is preferably applied in liquid form to the substrate. Thus, the softener mixtures, which are normally solid at room temperature, should first be melted and/or solvent treated with one of the liquid carriers disclosed hereinbefore. Methods of melting the mixture and/or for treating the mixture with a solvent can easily be carried out to provide a satisfactory softener-treated substrate.

In another preferred method, the sorbitan ester softener mixture in liquified form is placed in a pan or trough which can be heated to maintain the softener in liquid form. To the liquid mixture are then added any desired additives. A roll of absorbent paper (or cloth) is then set up on an apparatus so that it can unroll freely. As the paper unrolls, it travels downwardly and, submersed, passes through the pan or trough containing the liquid mixture at a slow enough speed to allow sufficient impregnation. The absorbent paper then travels upwardly and through a pair of rollers which remove excess bath liquid and provide the absorbent paper with about 1 gram to about 12 grams of the softening agent per 100 in.$^2$ to 150 in.$^2$ of substrate sheet. The impregnated paper is then cooled to room temperature, after which it can be folded, cut or perforated at uniform lengths, and subsequently packaged and/or used.

In another method of impregnation, the softener mixture, in liquid form, is sprayed onto absorbent paper as it unrolls and the excess softener is then squeezed off by the use of squeeze rollers or by a doctor-knife.

In applying the softener mixture to the absorbent substrate, the amount of mixture impregnated into the absorbent substrate is conveniently in the ratio range of 10:1 to 0.5:1 by weight softener mixture:dry, untreated substrate. Preferably, the amount of the softener mixture impregnated is from about 4:1 to about 1:1, particularly 1.25:1, by weight of the dry, untreated substrate.

Following application of the liquified softener mixture, the articles are held at room temperature until the mixture solidifies. The resulting dry articles, prepared at the softener mixture:substrate ratios set forth above, remain flexible; the sheet articles are suitable for packaging in rolls. The sheet articles can optionally be slitted or punched to provide a non-blocking aspect at any convenient time during the manufacturing process.

The most highly preferred articles herein are those where the sorbitan ester softener mixture is releasably affixed to a sheet substrate of the type disclosed hereinabove having an absorbent capacity of from about 5.5 to about 12. A highly preferred substrate for such an article has from about 40% to about 90% free space based on the overall volume of the substrate. The most highly preferred substrate for the articles comprises a water-laid or air-laid nonwoven cloth consisting essentially of lubricated, regenerated cellulosic (rayon) fibers, said fibers having a length of about 3/16 inch to about 2 inches and a denier from about 1.5 to about 5, said fibers being at least partially oriented haphazardly, and adhesively bonded together with a binder-resin. Such water-laid or air-laid non-woven cloths can easily be prepared having the preferred absorbent capacities and free space set forth above.

The most highly preferred articles herein are those wherein the flexible substrate is provided with openings sufficient in size and number to reduce restriction by said articles of the flow of air through the automatic dryer. Articles wherein the openings comprise a plurality of rectilinear slits extending along one dimension of the substrate, especially those wherein the slits extend to within 1 inch from at least one edge of said dimension of the substrate, articles wherein the slits comprise a plurality of curvilinear slits in a continuous pattern of U-shaped or C-shaped slits, and articles wherein the openings comprise circular holes, are highly preferred herein.

It is most convenient to provide an article in the form of a non-blocking sheet substrate having the physical parameters noted hereinabove, said substrate having an area of from about 50 in.$^2$ to about 200 in.$^2$, containing from about 1.5 grams to about 7.5 grams of the softener mixture releasably impregnated in said substrate. Such articles can be provided with, as an additional component, from about 0.01% to about 10% by weight of sorbitan ester softener mixture of a fabric treating additive of the type disclosed hereinabove. The articles are provided with openings such as the holes or slits described hereinabove, said openings comprising from about 0.5% to about 75%, preferably 5% to about 40%, of the area of the article, said openings being so disposed as to provide a non-blocking effect.

USAGE

In the process aspect of this invention the softener mixtures are used in an effective amount to soften and condition fabrics in an automatic dryer. The effective, i.e., softening and static-controlling, amount of the mixtures used in the manner of this invention will depend somewhat on the type of fabric being treated. For most purposes, the mixtures herein are applied to fabrics at a rate of about 0.01 gram to about 12.0 grams, preferably 2 g. to about 7 g., per 5 lbs. of fabric on a dry fabric weight basis. Higher usage rates can be employed, if desired, but can result in an undesirable greasy feel on the fabrics.

The process herein is carried out in the following manner. Damp fabrics, usually containing from about 1 to about 1.5 times their weight of water, are placed in the drum of an automatic clothes dryer. In practice, such damp fabrics are commonly obtained by laundering, rinsing and spin-drying the fabrics in a standard washing machine. The softener mixtures herein are simply spread uniformly over all fabric surfaces, for example, by sprinkling them onto the fabrics from a shaker device. Alternatively, the mixtures can be sprayed or otherwise coated on the dryer drum, itself. The dryer is then operated in standard fashion to dry the fabrics, usually at a temperature from about 50° C to about 80° C for a period from about 10 minutes to about 60 minutes, depending on the fabric load and type. On removal from the dryer, the dried fabrics are softened. Moreover, the fabrics instantaneously sorb a minute quantity of water which increases the electrical conductivity of the fabric surfaces, thereby quickly and effectively dissipating static charge.

In a preferred mode, the present process is carried out by fashioning an article comprising the dispensing means of the type hereinabove described in releasable combination with the softener mixture. This article is simply added to a clothes dryer together with the damp fabrics to be treated. The heat and tumbling action of the revolving dryer drum evenly distributes the softener mixture over all fabric surfaces, and dries the fabrics.

The following are non-limiting examples of the instant compositions and processes.

EXAMPLE I

A non-staining fabric softener mixture is prepared as follows.

S-Maz-60 (Mazer Chemical Co.; comprising 60% wt. sorbitan monostearate and ca. 5% wt. free stearic and other fatty acids; balance comprising isosorbide esters, and higher sorbitan esters) was neutralized with sodium hydroxide. Thereafter, an additional 5% wt. of 80% tallowalkyl/20% coconutalkyl sodium soaps was added thereto. The composition was blended thoroughly with a laboratory mixer. The resulting material was found to provide a mesomorphic phase under the conditions of temperature and heat in an automatic clothes dryer. When applied to fabrics, the mixture of neutralized S-Max-60 and soap did not substantially stain even all-polyester fabrics.

In the foregoing procedure, the 80 tallow/20 coconut soap is replaced by an equivalent amount of 50% tallowalkyl/50% coconutalkyl sodium soaps and sodium tallow alcohol sulfate, respectively, and equivalent results are secured.

EXAMPLE II

A dryer-added fabric softening article is prepared in the following manner. SPAN 60 (ICI's commerical mixture of sorbitan "stearate" comprising a total of about 90% by weight total sorbitan and isosorbide fatty esters, and approximately equal amounts of free fatty acid, free sorbitol, free sorbitan, minor proportions of isosorbide, about 31% by weight of the mixture comprising sorbitan monoesters) is reacted with sodium hydroxide until substantially no un-neutralized fatty acids remain. An additional 8% by weight of sodium tallowalkyl soap is blended with the neutralized SPAN 60 to provide a softener mixture.

The softener mixture prepared in the foregoing manner (3.0 grams) is sprinkled uniformly over the surface of an air-laid non-woven cloth comprising 70% regenerated cellulose (American Viscose Corporation) and 30% hydrophobic binder-resin (Rhoplex HA-8 on one side of the cloth, and Rhoplex HA-16 on the other side; Rohm & Haas, Inc.). The cloth has a thickness of 4 to 5 mils, a basis weight of about 24 grams per square yard and an absorbent capacity of 6. A one-foot length of the cloth, 8⅓ inches wide, weighs about 1.78 grams. The fibers in the cloth are ca. ¼ inch in length, 1.5 denier, and are oriented substantially haphazardly. The fibers in the cloth are lubricated with sodium oleate. The substrate cloth is 10 inches × 11 inches.

The cloth with the softener mixture is transferred to a heated plate, whereupon the mixture melts and impregnates the inter-fiber free space in the cloth substrate. The article is removed from the hot plate and allowed to cool to room temperature, whereby the softener mixture solidifies. The cloth retains its flexibility.

Following solidification of the softener mixture, the cloth is slitted with a knife. (Conveniently, the cloth is provided with 5 to 9 rectilinear slits extending along one dimension of the substrate, said slits being in a substantially parallel relationship and extending to within about one inch from at least one edge of said dimension of the substrate). The width of an individual slit is ca. 0.2 inches.

An article prepared in the foregoing manner is placed in an automatic clothes dryer together with 5 lbs. of freshly washed, damp (ca. 5.5 lbs. water) mixed cotton, polyester, and polyester/cotton blend clothes. The automatic dryer is operated at an average temperature of 60° C for a period of 45 minutes. During the course of the drying operation the clothes and softener article are constantly tumbled together by the rotation of the dryer drum. After the drying cycle, the clothes are removed from the dryer into a room having a relative humidity of 50. The clothes are found to exhibit excellent softness and anti-static properties with no substantial staining.

Equivalent results are secured when, in the foregoing article, the SPAN 60 is replaced by an equivalent amount of the following esters: 1,4-sorbitan monostearate; 1,5-sorbitan monostearate; a 1:1 (wt.) mixture of 1,4-sorbitan monostearate and 1,4-sorbitan distearate; a 1:1 (wt.) mixture of 1,5-sorbitan monostearate and 1,5-sorbitan distearate; a 1:1 (wt.) mixture of 1,4-sorbitan monostearate and 1,5-sorbitan monostearate; a 1:1 (wt.) mixture of 1,4-sorbitan monostearate and 1,5-sorbitan distearate; a 1:1 (wt.) mixture of 1,4-sorbitan distearate and 1,5-sorbitan monostearate; and a 1:1 (wt.) mixture of 1,4-sorbitan distearate and 1,5-sorbitan distearate, respectively.

In the foregoing procedure the sodium tallowalkyl soap is replaced by an equivalent amount of sodium tallowalkyl sulfate and equivalent results are secured.

EXAMPLE III

A non-staining dryer-added softener article is as follows. DURTAN 60 (Durkee Foods; comprising greater than 40% by weight stearic and palmitic acid esters of sorbitan, free stearic acid, free palmitic acid, free sorbitol, free sorbitan and minor amounts of isosorbide and esters thereof; 10 grams) is neutralized with sodium hydroxide. Sodium tallowalkyl sulfate (10% by weight of neutralized DURTAN 60) is blended uniformly into the esters to provide a softener mixture. The softener mixture is placed in a shallow trough and heated until melted.

A 10-inch wide roll of paper substrate, said substrate being a compressible, laminated and calendered absorbent paper structure comprising two extensible paper sheets, each sheet (or ply) having a basis weight of about 16 lbs. per 3,000 square feet and a MD value of about 660, a CD value of about 380 and 20% dry-crepe is used as the carrier. Each sheet of the paper substrate is embossed with identical raised patterns consisting of about 70 inwardly directed discrete proturberances per square inch, raised about 0.02 inch above the surface of the paper sheets. The protuberances constitute about 45% of the surface of each sheet and are mated and adhesively joined with polyvinyl alcohol resin. The paper structure exhibits a compressive modulus of about 340 together with HOM MD/CD values of about 36/31 and has an absorbent capacity of about 7. (This paper is a particularly preferred paper substrate herein and weighs about 3.7 grams per 11-inch × 12-inch sheet.)

The paper sheet substrate is mounted on a roll and is unrolled in the trough. The paper travels at a rate of 5–6 feet per minute and is then directed upwardly and through the pair of hard, rubber rollers mounted so that their surfaces just touch. The turning rollers squeeze off excess softener mixture and impregnate the paper with the softener at a softener: paper impregnation ratio of ca. 1.25:1 by weight of the dry, untreated paper.

An 11-in. × 12-in. paper-impregnated article prepared in the foregoing manner is punched with 9 evenly-spaced 0.5 in. diameter holes. The article is placed in an automatic clothes dryer together with 5 lbs. of mixed clothes (including dark, all-polyester fabrics) which are dampened with an equal amount of water. The dryer is operated at an average temperature of 56° C for a period of 40 minutes, with tumbling. At the end of the drying cycle, the dry clothing is provided with a soft, anti-static finish. No substantial staining is noted.

In the foregoing procedure the NaOH is replaced by KOH and equivalent results are secured.

In the foregoing procedure the sorbitan ester mixture is replaced by an equivalent amount of the sorbitan mono-, di- and tri-esters of behenic acid, and mixtures thereof, respectively, and equivalent results are secured.

An article is prepared in the manner of Example III, but without neutralizing the DURTAN 60 or adding the sodium tallowalkyl sulfate. Detectable staining is noted, especially when the article is used to soften dark, all-polyester fabrics.

What is claimed is:

1. A non-staining fabric softener mixture especially adapted for use in an automatic clothes dryer, comprising:

(a) a fabric softener component comprising a member selected from the group consisting of sorbitan esters characterized by at least one free hydroxyl group and a melting point of at least about 38° C, and mixtures thereof, said softener component being substantially free of un-neutralized fatty acids; and (b) a phase-modifying component selected from the group consisting of water-soluble fatty acid soaps, and mixtures thereof, and water-soluble $C_{10}$–$C_{20}$ neutralized alkyl sulfates, and mixtures thereof, the weight ratio of said softener component to said phase-modifying component being in the range of from about 100:1 to about 1:1;

said softener mixture being characterized by a melting point in the range of from about 38° C to about 100° C.

2. A composition according to claim 1 wherein the softener component is selected from the group consisting of $C_{10}$–$C_{24}$ alkyl mono-, di-, and tri-sorbitan esters, and mixtures thereof.

3. A composition according to claim 1 wherein the softener component is selected from the group consisting of sorbitan monolaurate, sorbitan monomyristate, sorbitan monopalmitate, sorbitan monostearate, sorbitan diluaurate, sorbitan dimyristate, sorbitan dipalmitate, sorbitan distearate, and mixtures thereof, and wherein the phase modifying component is a fatty acid soap, or mixtures thereof, at a weight ratio of sorbitan ester to soap of from about 100:1 to about 1:1.

4. A composition according to claim 3 wherein the soap is in the sodium salt form.

5. A composition according to claim 4 wherein the soap is sodium tallowalkyl soap, sodium coconutalkyl soap, or mixtures thereof.

6. A composition according to claim 1 wherein the softener component is selected from the group consisting of sorbitan monolaurate, sorbitan monomyristate, sorbitan monopalmitate, sorbitan monostearate, sorbitan dilaurate, sorbitan dimyristate, sorbitan dipalmitate, sorbitan distearate, and mixtures thereof, and wherein the phase-modifying component is a water-soluble neutralized $C_{10}$–$C_{20}$ alkyl sulfate, or mixtures thereof, at a weight ratio of sorbitan ester:alkyl sulfate of from about 100:1 to about 1:1.

7. A composition according to claim 6 wherein the alkyl sulfate is in the sodium salt form.

8. A composition according to claim 7 wherein the alkyl sulfate is sodium tallowalkyl sulfate.

9. A process for conditioning fabrics comprising tumbling said fabrics with an effective amount of a softening mixture comprising a sorbitan ester containing at least one free hydroxyl group, said ester being free of un-neutralized fatty acids, and a $C_{10}$–$C_{20}$ neutralized alkyl sulfate or fatty acid soap.

* * * * *